US007607897B2

(12) United States Patent
Watanabe et al.

(10) Patent No.: US 7,607,897 B2
(45) Date of Patent: Oct. 27, 2009

(54) RECIPROCATING COMPRESSOR

(75) Inventors: Satoshi Watanabe, Saitama (JP); Minoru Kanaizuka, Saitama (JP); Yasunori Hujita, Saitama (JP); Ryosuke Izawa, Saitama (JP); Toshiaki Kuribara, Saitama (JP); Hironori Tomita, Saitama (JP); Hirofumi Kobayashi, Saitama (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 284 days.

(21) Appl. No.: 10/550,546

(22) PCT Filed: Nov. 17, 2003

(86) PCT No.: PCT/JP03/14565

§ 371 (c)(1),
(2), (4) Date: Sep. 26, 2005

(87) PCT Pub. No.: WO2004/088139

PCT Pub. Date: Oct. 14, 2004

(65) Prior Publication Data

US 2006/0140785 A1 Jun. 29, 2006

(30) Foreign Application Priority Data

Mar. 28, 2003 (JP) ..... 2003-091581

(51) Int. Cl.
*F04B 1/12* (2006.01)
*F04B 27/08* (2006.01)

(52) U.S. Cl. ..... 417/269; 417/312

(58) Field of Classification Search ..... 417/269, 417/312

See application file for complete search history.

(56) References Cited

U.S. PATENT DOCUMENTS 4,274,813 A * 6/1981 Kishi et al. ..... 417/269

(Continued)

FOREIGN PATENT DOCUMENTS

EP 0 330 965 A1 9/1989
JP 11-117859 A 4/1999

OTHER PUBLICATIONS

Supplementary European Search Report, Ref. Z 1051 EP (dated Dec. 1, 2006).
International Search Report mailed on Mar. 2, 2004.

*Primary Examiner*—Devon C Kramer
*Assistant Examiner*—Amene S Bayou
(74) *Attorney, Agent, or Firm*—Rader, Fishman & Grauer, PLLC

(57) ABSTRACT

A reciprocating compressor includes a cylinder block having formed therein a plurality of cylinders, pistons that make reciprocal movement inside the cylinders, a first cylinder head fixed to one end of the cylinder block via a valve plate, a second cylinder head fixed to another end of the cylinder block via a valve plate, a first delivery chamber formed at the first cylinder head, into which a working fluid let out from a first compression space formed toward one end inside each of the cylinders is guided, a second delivery chamber formed at the second cylinder head, into which a working fluid let out from a second compression space formed toward another end inside each of the cylinders is guided, a plurality of delivery passages formed at the cylinder block and an outlet port located at the cylinder block or the cylinder head.

6 Claims, 10 Drawing Sheets

U.S. PATENT DOCUMENTS 4,452,571 A * 6/1984 Koda et al. ..... 417/286
4,544,332 A * 10/1985 Shibuya ..... 417/269
4,652,217 A * 3/1987 Shibuya ..... 417/269
4,715,790 A * 12/1987 Iijima et al. ..... 417/269
4,768,928 A * 9/1988 Miller ..... 417/269
4,863,356 A * 9/1989 Ikeda et al. ..... 417/269
5,100,306 A * 3/1992 Moran et al. ..... 417/571
5,139,392 A * 8/1992 Pettitt et al. ..... 417/269
5,173,032 A * 12/1992 Taguchi et al. ..... 417/222.2
5,533,871 A * 7/1996 Takenaka et al. ..... 417/269
5,765,996 A * 6/1998 Fujii et al. ..... 417/269
5,800,147 A * 9/1998 Arai et al. ..... 417/269
5,809,865 A 9/1998 Ikeda et al.
6,077,049 A * 6/2000 Nakamura et al. ..... 417/269
6,149,397 A * 11/2000 Mizutani et al. ..... 417/222.2
6,296,457 B1 * 10/2001 Shintoku et al. ..... 417/312
6,318,980 B1 * 11/2001 Kurihara et al. ..... 417/571
6,382,938 B1 * 5/2002 Murao et al. ..... 417/540
6,568,924 B2 * 5/2003 Kawamura et al. ..... 417/540
6,575,708 B2 * 6/2003 DeWispelaere ..... 417/269
6,851,937 B2 * 2/2005 Choi et al. ..... 417/269

* cited by examiner

RECIPROCATING COMPRESSOR

CROSS-REFERENCE TO RELATED APPLICATIONS

This application is the U.S. National Phase Application, under 35 USC 371 of International Application PCT/JP2003/014565, filed on Nov. 17, 2003, published as WO 2004/088139 A1 on Oct. 10, 2004, and claiming priority to JP 2003-091581, filed Mar. 28, 2003, the disclosures of all of which are incorporated herein by reference.

TECHNICAL FIELD

The present invention relates to a reciprocating compressor ideal in applications in which a working fluid such as a coolant gas needs to be compressed, and more specifically, it relates to a structure particularly effective in reducing the pulsation of the discharge gas.

BACKGROUND ART

A reciprocating compressor in the related art adopts a structure comprising a cylinder block having a plurality of cylinders formed therein, pistons that make reciprocal movement inside the cylinders, a front-side cylinder head fixed to one end of the cylinder block via a valve plate, a rear-side cylinder head fixed to the other end of the cylinder block via a valve plate, a front-side delivery chamber formed at the front-side cylinder head, into which a working fluid let out from front-side compression spaces formed on the front side within the cylinders is guided, a rear-side delivery chamber formed at the rear-side cylinder head, into which the working fluid let out from rear-side compression spaces formed on the rear side of the cylinders is guided, a plurality of delivery passages formed at the cylinder block to range substantially parallel to the cylinders and an outlet port located at either the cylinder block or a cylinder head, which communicates between one of the delivery passages and an external circuit, with another delivery passage that does not communicate with the outlet port made to communicate with the front-side delivery chamber and the rear-side delivery chamber and also made to communicate with the delivery passage communicating with the outlet port via a guide passage (see Japanese Unexamined Patent Publication No. H11-117859).

In this structure, the coolant gas delivered into the compression spaces is let out to the external circuit from the outlet port via the delivery passage, which is not in communication with the outlet port, the guide passage and the delivery passage communicating with the outlet port and thus, any stagnation of the coolant gas in the delivery passage, which is not in communication with the outlet port, can be eliminated. This allows both delivery passages to be used as effective mufflers so as to reduce the extent of pulsation.

In addition, since the end of the delivery passage communicating with the outlet port, located on the opposite side from the outlet port side, is closed off, one end of the guide passage is made to open toward the end of the delivery passage communicating with the outlet port, which is located on the opposite side from the outlet port side, so as to ensure that the space at the closed and does not become a refuge for the working fluid and that the volumetric capacity of the space can still be effectively used as a passage for the working fluid in Patent Reference Literature 1 described above.

However, while the extent of pulsation can be reduced to some extent in the reciprocating compressor described above, it has been found to manifest a drastic increase in the level of discharge pulsation over a specific rotational rate range (1200 to 1600 rpm). For this reason, there are limits to the extent to which vibration and noise at the compressor can be reduced.

In addition, in an automotive refrigerating cycle equipped with the compressor described above, the liquid coolant starts to collect inside the compressor when the compressor is left in an OFF state over an extended period of time. In this situation, the internal pressure at the evaporator connected on the intake side of the compressor rises as the temperature inside the cabin increases. Thus, if the path between the intake port and the outlet port inside the compressor is blocked by the liquid coolant, an increase in intake pressure will cause the liquid coolant containing oil inside the compressor to be pushed out and, as this process is repeated, a large quantity of oil ends up being taken out from the compressor. Then, as the compressor without sufficient oil therein is started up, the compressor may, in the worst-case scenario, seize up.

While the relative increase occurs in the extent of discharge pulsation over the specific rotational rate range as described above, the compressor in which the working coolant having been delivered into the front-side delivery chamber and the working coolant having been delivered into the rear-side delivery chamber then flow from the individual delivery chambers along directions opposite from each other through the delivery passage to collide with and join each other at a middle position inside the delivery passage, tends to induce pulsation readily in the first place. For this reason, further measures must be taken to reduce the extent of pulsation of the working fluid having flowed in one direction and the working fluid having flowed in the other direction, joining each other within the delivery passage, in the compressor with this particular delivery path.

A primary object of the present invention, which has been completed by addressing the problems discussed above, is to reduce vibration and noise by reducing the extent of discharge pulsation attributable to the structure of the compressor. Another object of the present invention is to provide a reciprocating compressor with which a reduction in the extent of discharge pulsation and a reduction in the extent to which oil is allowed to flow out can both be achieved.

DISCLOSURE OF THE INVENTION

In order to achieve the objects described above, the present invention provides a reciprocating compressor, comprising a cylinder block having formed therein a plurality of cylinders, pistons that make reciprocal movement inside the cylinders, a first cylinder head fixed to one end of the cylinder block via a valve plate, a second cylinder head fixed to another end of the cylinder block via a valve plate, a first delivery chamber formed at the first cylinder head, into which a working fluid let out from a first compression space formed toward one end inside each of the cylinders is guided, a second delivery chamber formed at the second cylinder head, into which a working fluid let out from a second compression space formed toward another end inside each of the cylinders is guided, a plurality of delivery passages formed at the cylinder block and an outlet port located at the cylinder block or the cylinder head, which communicates between one of the delivery passages and an external circuit, with the other delivery passage that does not communicate with the outlet port made to communicate with the first delivery chamber and the second delivery chamber and also made to communicate via a guide passage with the delivery passage in communication with the outlet port. The reciprocating compressor is characterized in that the delivery passage in communication with the outlet port is made to communicate with at least either the first delivery chamber or the second delivery chamber via a constricted portion having a smaller passage section than the passage section over the areas where the other delivery passage communicates with the first delivery chamber, and the second delivery chamber and that the dimensions of the constricted portion are set so as to achieve an area equal to or less than the area of a circular section with a diameter of 1.5 mm.

Thus, while the working fluid having been delivered into the first delivery chamber and the second delivery chamber is guided to the delivery passage communicating with the outlet port from the other delivery passage that is not in communication with the outlet port via the guide passage and is then let out to the external circuit from the outlet port in this structure, the delivery passage in communication with the outlet port is also in communication with at least either the first delivery chamber or the second delivery chamber via the constricted portion so that even when the compressor having been in an OFF state over an extended period of time is restarted, the working fluid delivered into the delivery chambers is directly guided to the delivery passage in communication with the outlet port via the constricted portion to disrupt the balance of pressure within the delivery passage in communication with the outlet port, which makes it possible to lower the extent of the discharge pulsation over the specific rotational rate range.

In addition, even when the compressor is left in an OFF state over an extended period of time, allowing the liquid coolant to collect inside the compressor to block the path between the intake port and the outlet port, the delivery chamber is made to directly communicate via the constricted portion with the delivery passage in communication with the outlet port and thus, even as an increase in the temperature inside the cabin raises the intake pressure at the compressor, the raised intake pressure does not push out the oil inside the compressor together with the liquid coolant. As a result, it is ensured that the compressor never runs short of oil for internal circulation.

While a wider constricted portion will allow the working fluid bypassing the other delivery passage to be more easily guided to the delivery passage in communication with the outlet port, such a constricted portion with a significant passage area does not restrict the flow of the fluid as effectively and increases the extent of the discharge pulsation. For this reason, the area of the constricted portion is set equal to or less than the area of a circular section with a diameter of 1.5 mm to ensure that the extent to which the oil inside the compressor is allowed to flow out and the extent of the discharge causation are both reduced.

Since the working fluid collected inside the compressor left in a non-operating state tends to gather in the lower delivery passage, it is desirable that the delivery passage to communicate with the outlet port be formed at a position higher than the position of the other delivery passage.

The present invention also provides a reciprocating compressor, comprising a cylinder block having formed therein a plurality of cylinders, pistons that make reciprocal movement inside the cylinders, a first cylinder head fixed to one end of the cylinder block via a valve plate, a second cylinder head fixed to another end of the cylinder block via a valve plate, a first delivery chamber formed at the first cylinder head, to which a working fluid let out from a first compression space formed toward one end inside each of the cylinders is guided, a second delivery chamber formed at the second cylinder head, into which a working fluid let out from a second compression space formed toward another end inside each of the cylinders is guided, a plurality of delivery passages formed at the cylinder block and an outlet port located at the cylinder block or the cylinder head, which communicates between one of the delivery passages and an external circuit, with the other delivery passage that does not communicate with the outlet port made to communicate with the first delivery chamber and the second delivery chamber and also made to communicate via a guide passage with the delivery passage in communication with the outlet port. The reciprocating compressor is characterized in that the other delivery passage is made to communicate with the first delivery chamber and the second delivery chamber each via a constricted portion having a relatively small passage section.

While the working fluid delivered into the first delivery chamber and the second delivery chamber is guided from another delivery passage that is not in communication with the outlet port to the delivery passage in communication with the outlet port via the guide passage and is then let out to the external circuit through the outlet port in this structure, the pulsation of the working fluid from the first delivery chamber and the pulsation of the working fluid from the second delivery chamber, both guided into the other delivery passage, are individually reduced at the constricted portions before they join each other at the guide passage, reducing the extent of the pulsation of the joined working fluid, which makes it possible to reduce the overall extent of discharge pulsation.

The structure for reducing the extent of the pulsation of the joined working fluid, i.e., the extent of discharge pulsation, may be preferably achieved by setting the length of the path extending from the first delivery chamber to the guide passage and the length of the path extending from the second delivery chamber to the guide passage substantially equal to each other or by setting the measurement of the first delivery chamber along the axial direction and the measurement of the second delivery chamber along the axial direction substantially equal to each other.

The constricted portion may be formed at a valve plate or the cylinder block. Alternatively, it may be formed with a gap between the cylinder block and a valve or a gasket disposed between the cylinder block and the valve plate (claims 6, 7 and 8). The structure described above may further include an additional constricted portion formed at the outlet port or at a position immediately preceding the outlet port so as to enhance the damping effect with which the discharge pulsation is damped.

BEST MODE FOR CARRYING OUT THE INVENTION

Figure 1:
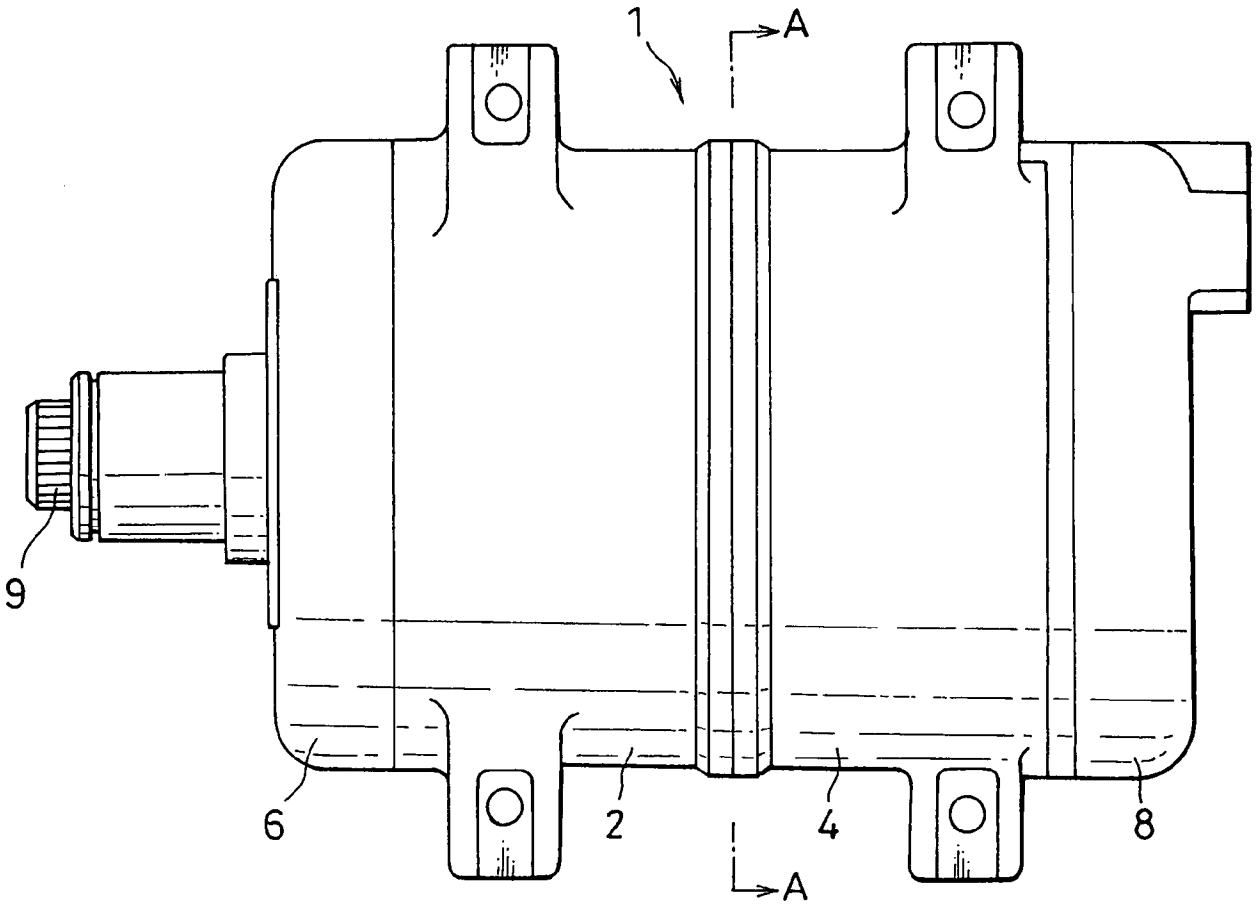
FIG. 1 is a side elevation, presenting an external view of a reciprocating compressor according to the present invention.
Figure 2:
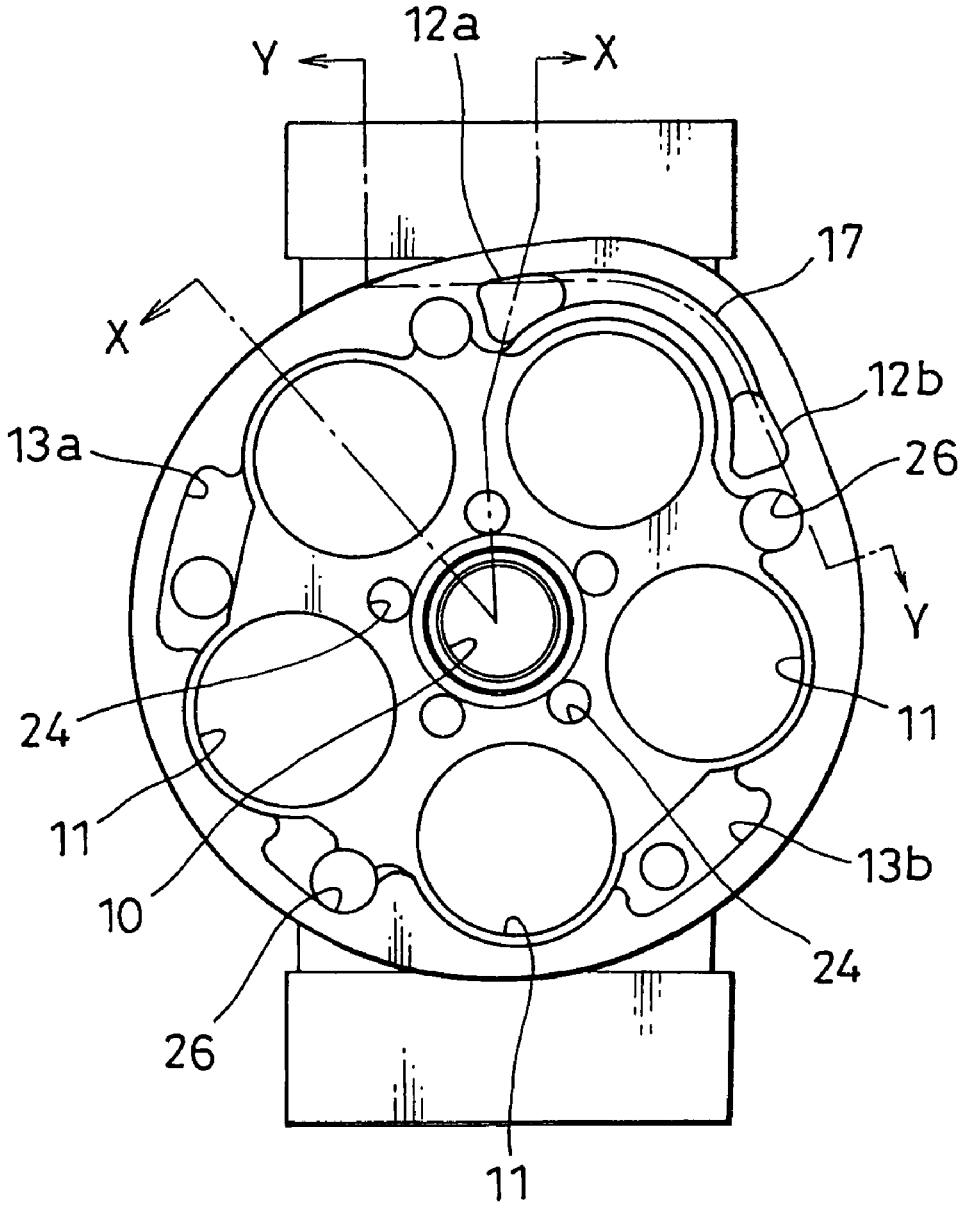
FIG. 2 shows the end surface of the cylinder block taken through line A-A in FIG. 1.
Figure 3:
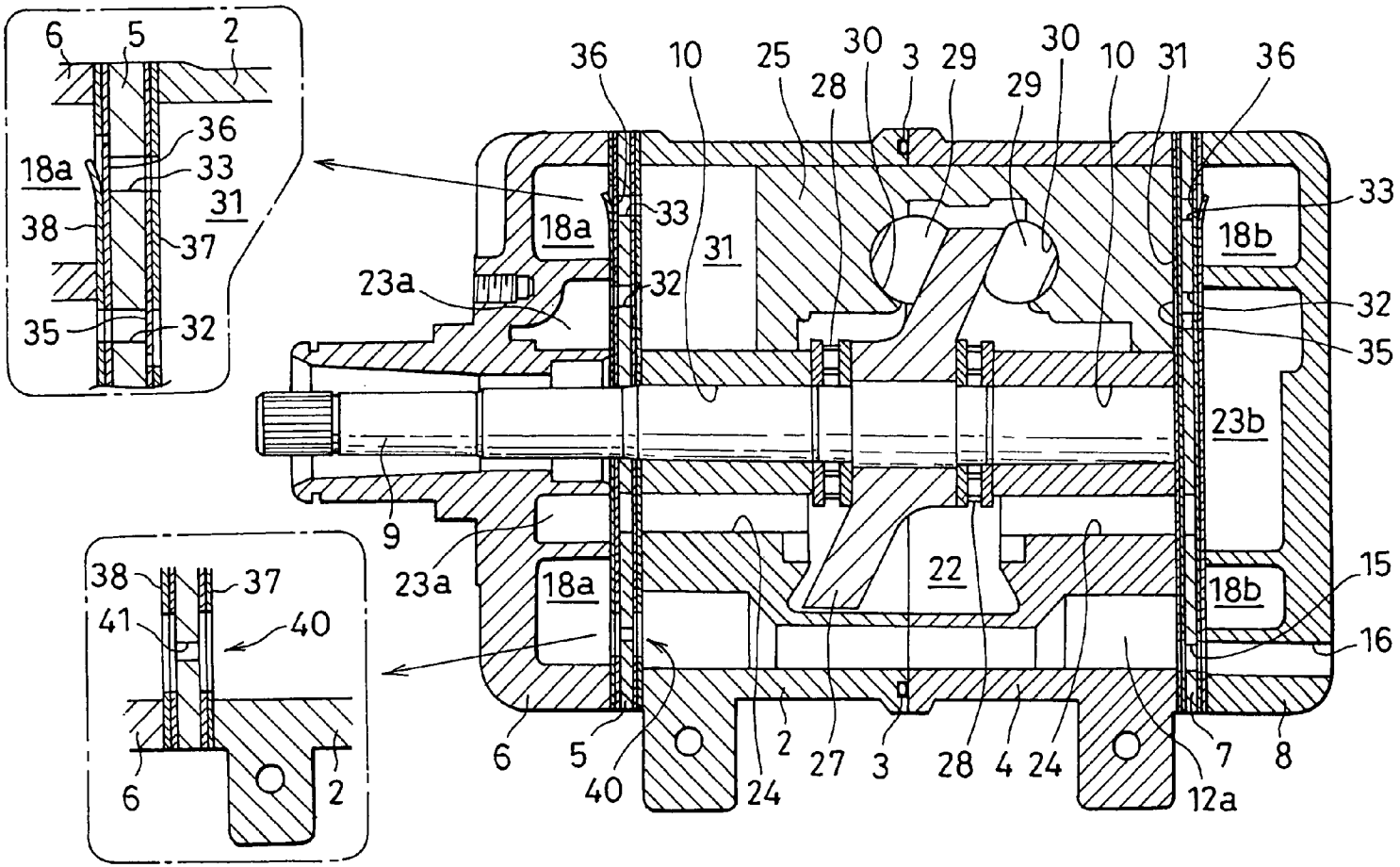
FIG. 3 is a sectional view of the reciprocating compressor according to the present invention, taken through line X-X in FIG. 2.
Figure 4:
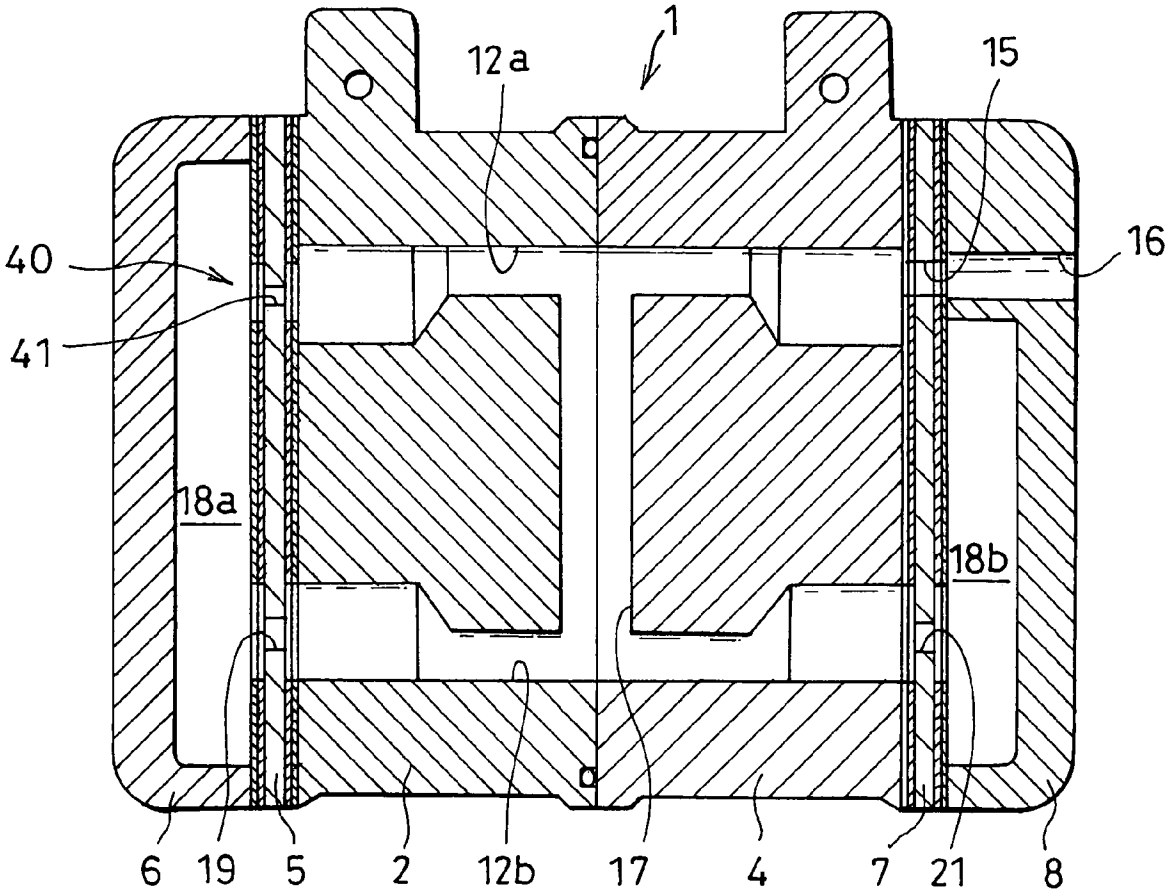
FIG. 4 is a sectional view taken through line Y-Y in FIG. 2.

The following is an explanation of an embodiment of the present invention, given in reference to drawings. A reciprocating compressor 1 in FIGS. 1 through 4 is employed in a refrigerating cycle in which a coolant is used as a working fluid. The compressor 1 comprises a front-side cylinder block 2, a rear-side cylinder block 4 that is mounted at the front-side cylinder block 2 via an O-ring 3 or a gasket (not shown), or through metal contact, a front-side cylinder head 6 that is mounted on the front side (the left side in the figures) of the front-side cylinder block 2 via a valve plate 5 and a rear-side cylinder head 8 that is mounted on the rear side (the right side in the figures) of the rear-side cylinder block 4 via a valve plate 7. The front-side cylinder head 6, the valve plate 5, the front-side cylinder block 2, the rear-side cylinder block 4, the valve plate 7 and the rear-side cylinder head 8 are fastened together along the axial direct-ion with fastening bolts (not shown), thereby constituting a housing for the entire compressor.

At each of the cylinder blocks 2 and 4, a shaft support hole 10 at which a shaft 9 to be detailed later is rotatably supported, a plurality of (e.g., five) cylinders 11 extending parallel to the shaft support hole 10 and disposed over equal intervals on the circumference of a circle centered around the shaft 9, two delivery passages 12*a* and 12*b* running parallel to the cylinders 11 and intake passages 13*a* and 13*b* through which a low-pressure working fluid flows are formed.

One of the delivery passages, i.e., the delivery passage 12*a*, is connected via a communicating port 15 formed at the valve plate 7 or the like to an outlet port 16 formed at the cylinder head 8 and communicates with an external circuit. In addition, the other delivery passage 12*b* is connected to the delivery passage 12*a* via a guide passage 17, is made to communicate via a communicating port 19 formed at the valve plate 5 with a delivery chamber 18*a* formed at the front-side cylinder head 6 to be detailed later and is also made to communicate via a communicating port 21 formed at the valve plate 7 with a delivery chamber 18*b* formed at the rear-side cylinder head 8. It is to be noted that the outlet port 16 communicating with the delivery passage 12*a* may be formed on the external circumferential surface of the cylinder block.

In addition, the intake passages 13*a* and 13*b* are connected with a swashplate housing chamber 22 to be detailed below, and are further connected via the swashplate housing chamber 22 with low-pressure passages 24 in communication with intake chambers 23*a* and 23*b* respectively formed at the cylinder heads 6 and 8. A double-ended piston 25 is slidably inserted at each cylinder 11. It is to be noted that reference numeral 26 in the figure indicates a bolt insertion hole formed between cylinders 11 at which a fastening bolt is inserted.

Inside the front-side cylinder block 2 and the rear-side cylinder block 4, the swashplate housing chamber 22, which is defined by attaching the individual cylinder blocks to each other, is formed, and the shaft 9 inserted in the shaft support hole 10 formed at the front-side cylinder block 2 and the rear-side cylinder block 4 and having one end thereof projecting out beyond the front-side cylinder head 6 to allow the armature of an electromagnetic clutch (not shown) to be mounted thereat is disposed in the swashplate housing chamber 22.

A swashplate 27, which rotates as one with the shaft 9 inside the swashplate housing chamber 22, is fixed onto the shaft 9. The swashplate 27, which is rotatably supported at the front-side cylinder block 2 and the rear-side cylinder block 4 via thrust bearings 28 is held at a shoe pocket formed at the center of the double-ended pistons 25 via a pair of semispherical shoes 29 disposed so as to sandwich the edge of the swashplate from the front and the rear. Thus, as the shaft 9 rotates, causing the swashplate 27 to rotate, the rotational motion of the swashplate is converted to a linear reciprocal movement of the double-ended pistons 25 via the shoes 29. As each double-ended piston 25 moves reciprocally, the volumetric capacities of compression spaces 31 formed between the piston 25 and the valve plates 5 and 7 inside the cylinder 11 change.

Figure 5:
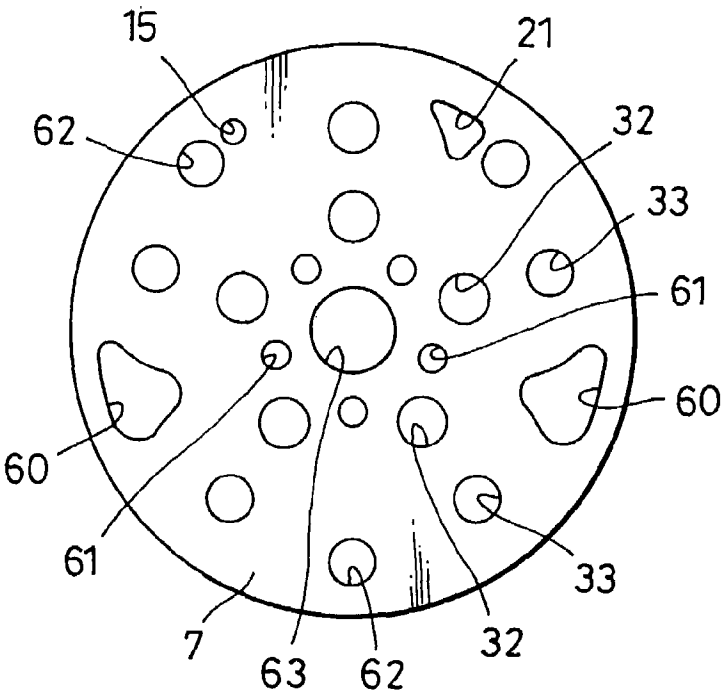
FIG. 5 shows the valve plates, with FIG. 5(*a*) showing the front-side valve plate and FIG. 5(*b*) showing the rear-side valve plate.
Figure 5:
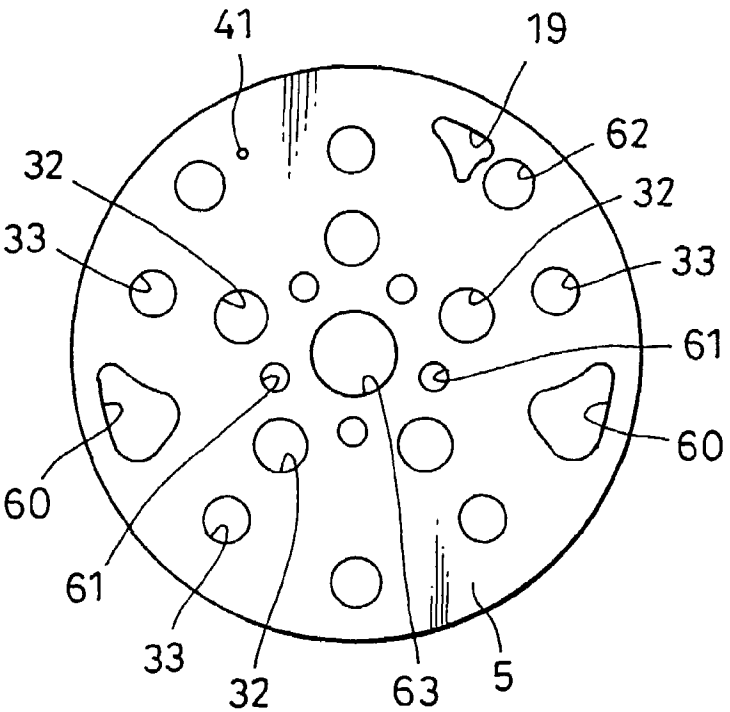

At each of the valve plates 5 and 7, an intake hole 32 and an outlet hole 33 are formed in correspondence to each cylinder 11, as shown in FIG. 5. The intake chambers 23*a* and 23*b*, in which the working fluid to be supplied to the compression spaces 31 is stored and delivery chambers 18*a* and 18*b*, in which the working fluid let out from the compression spaces 31 is collected are formed respectively at the front-side cylinder head 6 and the rear-side cylinder head 8. The intake chambers 23*a* and 23*b* respectively are made to communicate with the compression spaces 31 via the intake holes 32 at the valve plates 5 and 7, whereas the delivery chambers 18*a* and 18*b* formed continuously around the intake chambers 23*a* and 23*b* are made to communicate with the compression spaces 31 via the outlet holes 33 at the valve plates 5 and 7. It is to be noted that in FIG. 5, reference numeral 60 indicates passing holes formed at positions facing opposite the intake passages 13*a* and 13*b* reference numeral 61 indicates passing holes formed at positions facing opposite the low-pressure passage 24, reference numeral 62 indicates passing holes formed at positions facing opposite the bolt insertion holes 26 and reference numeral 63 indicates passing holes formed at positions facing opposite the shaft support hole 10, when the valve plates 5 and 7 are set against the cylinder blocks 2 and 4.

The intake holes 32 are opened/closed by intake valves 35 disposed at the end surfaces of the valve plate 5 and 7 located toward the cylinder blocks, whereas the outlet holes 33 are opened/closed by outlet valves 36 disposed at the end surfaces of the valve plates 5 and 7 located toward the cylinder heads. It is to be noted that reference numeral 37 indicates gaskets disposed at the valve plates 5 and 7 on the sides toward the cylinder blocks to seal the space between the valve plates and the cylinder blocks via the intake valves 35, and reference 38 indicates gaskets disposed at the valve plates 5 and 7 on the side toward the cylinder heads to seal the spaces between the valve plates and the cylinder heads 6 and 8 via the outlet valves 36.

Figure 6:
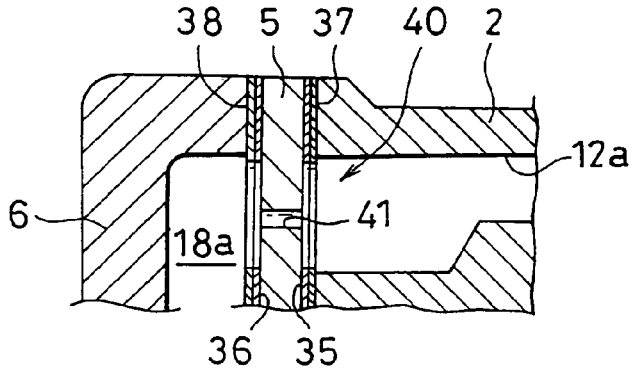
FIG. 6 is a sectional view, showing in an enlargement the constricted portion in FIG. 4 and the area around the constricted portion.

In addition, the delivery passage 12*a* is made to communicate with the front-side delivery chamber 18 via a constricted portion 40 in this structure. The constricted portion 40 in this structural example is constituted with a passing hole 41 assuming the shape of an orifice, which is formed at the front-side valve plate 5, as shown in FIG. 6, and the dimensions of the constricted portion 40 are set so as to achieve a smaller passage section compared to those of the communicating ports 15, 19 and 21.

Thus, during an intake stroke, through which the volumetric capacities of the compression spaces 31 increase as the pistons 25 move reciprocally, the working fluid is taken into the compression spaces 31 from the intake chambers 23*a* and 23*b* via the intake holes 32 and the intake valves 35, whereas during a compression stroke, through which the volumetric capacities of the compression spaces 31 decrease, the working fluid having been compressed at the compression spaces 31 is forced out to the delivery chambers 18*a* and 18*b* at the front-side cylinder head and the rear-side cylinder head via the outlet holes 33 and the outlet valves 36. The working fluid let out into the delivery chambers 18*a* and 18*b* then enters the delivery passage 12*b* via the communicating ports 19 and 21 and also enters the delivery passage 12*a* via the constricted portion 40. The working fluid having entered the delivery passage 12*b* from the delivery chamber 18*a* and the working fluid having entered the delivery passage 12*b* from the delivery chamber 18*b* collide with each other roughly halfway through the delivery passage 12*b* and the joined working fluid is guided to the delivery passage 12*a* through the guide passage 17. The working fluid and thus guided into the delivery passage 12*a* joins the working fluid having flowed into the delivery passage 12*a* from the front-side delivery chamber 18*a* via the constricted portion 40 at roughly the middle of the delivery passage 12*a*, and the joined working fluid is forced out to the external circuit from the outlet port 16 via the communicating port 15.

Thus, after the working fluid is delivered into the delivery chambers, its flow is constricted at the communication ports 19 and 21 and also at the communicating port 15 before it is guided to the outlet port 16. During this process, the balance of pressure within the passage 12*a* is disrupted by the working fluid flowing into the delivery passage 12*a* from the constricted portion 40, which damps the extent of discharge pulsation occurring in a specific rotational rate range.

In addition, if the compressor 1 adopting the structure described above is left in an OFF state over an extended period of time, the working fluid at the external circuit is allowed to return via a piping to fill the lower delivery passage 12*b*. As the compressor 1 is restarted in this state and the working fluid is let out from the compression spaces 31 to the delivery chambers 18*a* and 18*b*, the levels of the pressures in the delivery chambers 18*a* and 18*b* are raised, which would push out the working fluid having been present in the delivery passage 12*b*. However, since the front-side delivery chamber 18*a* is in communication with the upper delivery passage 12*a* via the constricted portion 40, the pressure in the front-side delivery chamber 18*a* is guided into the delivery passage 12*a* via the constricted portion 40. As a result, the working fluid filling the lower delivery passage 12*b* is not pushed out in large quantity at once, and ultimately, the extent of oil loss inside the compressor is lowered as well.

The machining process may be facilitated and productivity may be improved by forming the constricted portion 40 in a significant size. However, if the passage area of the constricted portion 40 is large, the level of pulsation of the working fluid becomes significant, and accordingly, the constricted portion 40 must be formed in a size that meets the two requirements, i.e., prevention of oil loss and reduction of the discharge pulsation. The results of the tests conducted by the inventor of the present invention et al. from this viewpoint indicate that the ideal size of the constricted portion (orifice) at which the extent of oil loss is reduced and the discharge pulsation is reduced to a degree that the external cycle is no longer affected, is equivalent to an area equal to or smaller than that of a circular section with a diameter of 1.5 mm.

By providing such a constricted portion 40, the oil is not allowed to flow out readily at the compressor startup and also, vibration of the piping and unpleasant noise attributable to pulsation can be reduced by keeping the level of discharge pulsation within the allowable range.

Figure 7:
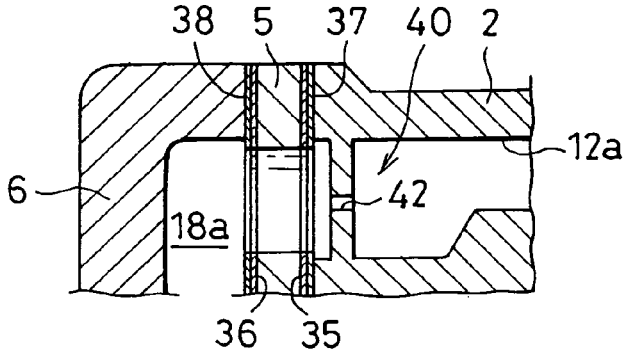
FIG. 7 is a sectional view showing in an enlargement another example that may be adopted in the constricted portion in FIG. 4.
Figure 8:
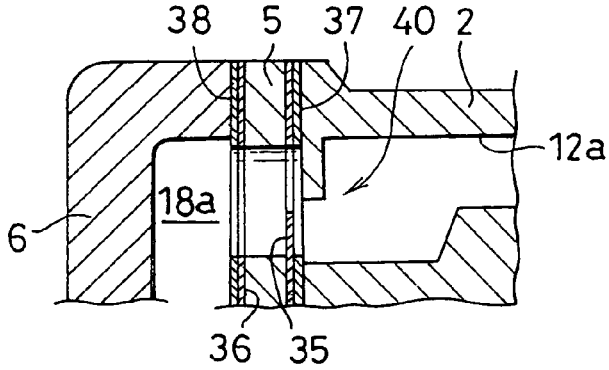
FIG. 8 is a sectional view showing in an enlargement yet another example that may be adopted in the constricted portion in FIG. 4.
Figure 9:
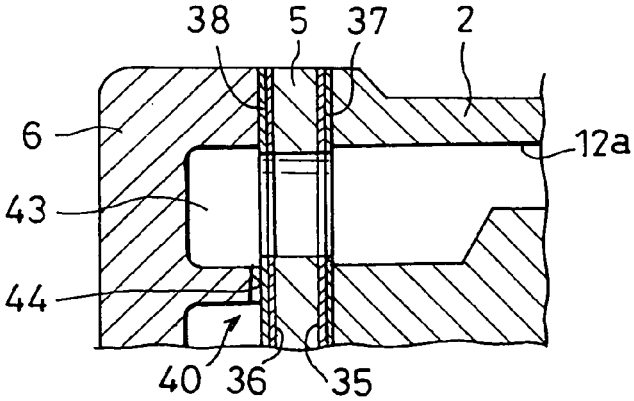
FIG. 9 is a sectional view showing in an enlargement yet another example that may be adopted in the constricted portion in FIG. 4.
Figure 10:
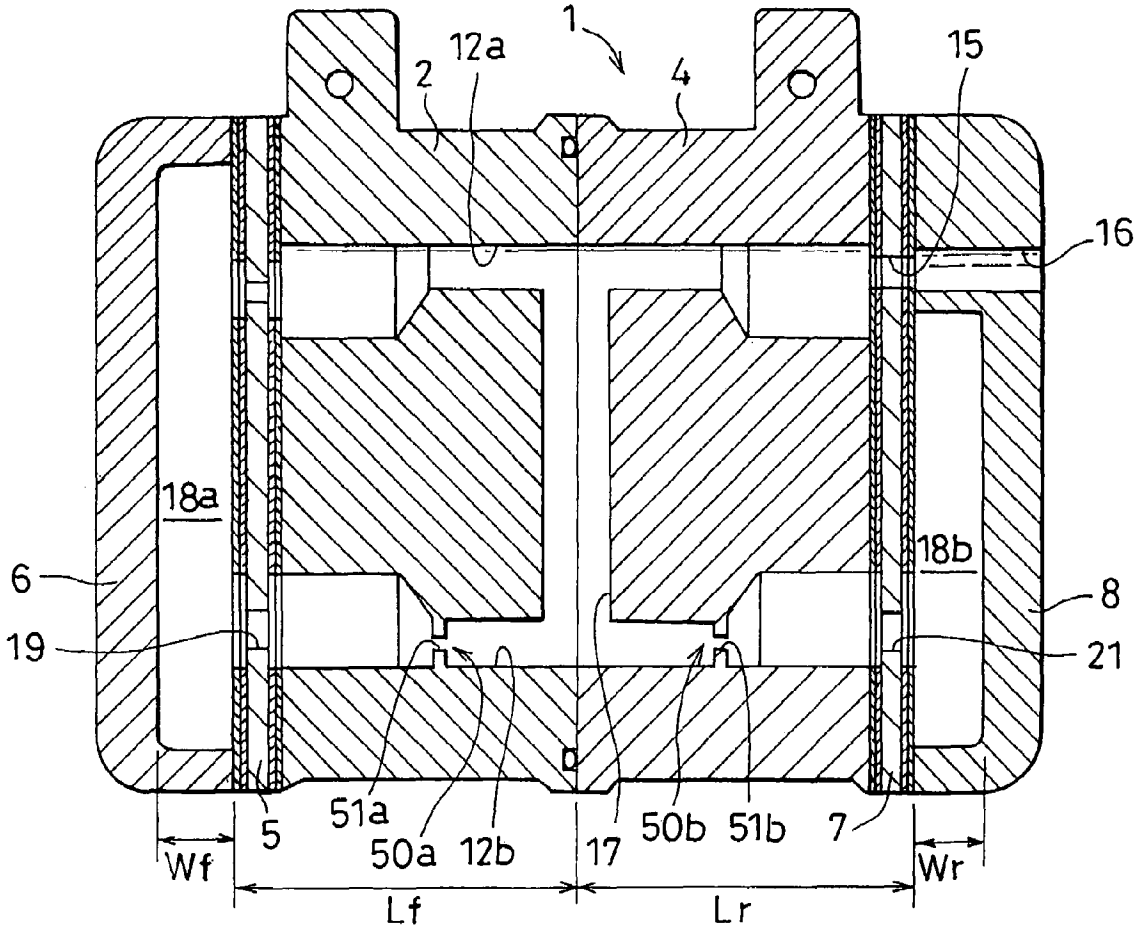
FIG. 10 is a sectional view showing a structural example adopted in another reciprocating compressor according to the present invention, having constricted portions formed in a delivery passage.

It is to be noted that while the constricted portion 40 is constituted with the passing hole 41 formed at the valve plate 5 in the structural example described above, the constricted portion 40 may instead be constituted with a passing hole 42 formed as an orifice at the cylinder block 2, as shown in FIG. 7, or it may be formed as shown in FIG. 8 by reducing the passage area with the cylinder block 2 and an intake valve 35 or the gasket 37 (with an intake valve 35 in the figure). Alternatively, it may be formed at the cylinder head 6 by forming at the delivery chamber 18*a* a small space 43 to communicate with the delivery passage 12*a* and communicating the small space 43 with the remaining portion of the delivery chamber 18*a* via a slit 44, as shown in FIG. 9.

While the delivery passage 12*a* communicates with the front-side delivery chamber 18*a* via the constricted portion 40 in the structural examples described above, the delivery passage 12*a* may be made to communicate with the rear-side delivery chamber 18*b* via a constricted portion instead of with the front-side delivery chamber 18*a* or in addition to the front-side delivery chamber 18*a*.

In the structure described above, the extent of discharge pulsation is lowered partially by setting the passage length Lf of the delivery passage 12*b* extending from the front-side delivery chamber 18*a* to the guide passage 17 and the passage length Lr of the delivery passage 12*b* extending from the rear-side delivery chamber 18*b* to the guide passage 17 substantially equal to each other so as to allow the working fluid from the front-side delivery chamber 18*a* and the working fluid from the rear-side delivery chamber 18*b* to travel substantially equal distances before they join each other. As an alternative to or addition to this, constricted portions 50*a* and 50*b* may be formed by partially reducing the passage section of the delivery passage 12*b* respectively within the path extending from the front-side delivery chamber 18*a* to the guide passage 17 and within the path extending from the rear-side delivery chamber 18*b* to the guide passage 17. These constricted portions 50*a* and 50*b* may be formed as orifice-like passing holes 51*a* and 51*b* at the cylinder blocks 2 and 4 respectively by partially reducing the passage section of the delivery passage 12*b* so that the working fluid from the delivery chamber 18*a* and the working fluid from the delivery chamber 18*b* join each other after they pass through the constricted portions 50*a* and 50*b* respectively.

Figure 11:
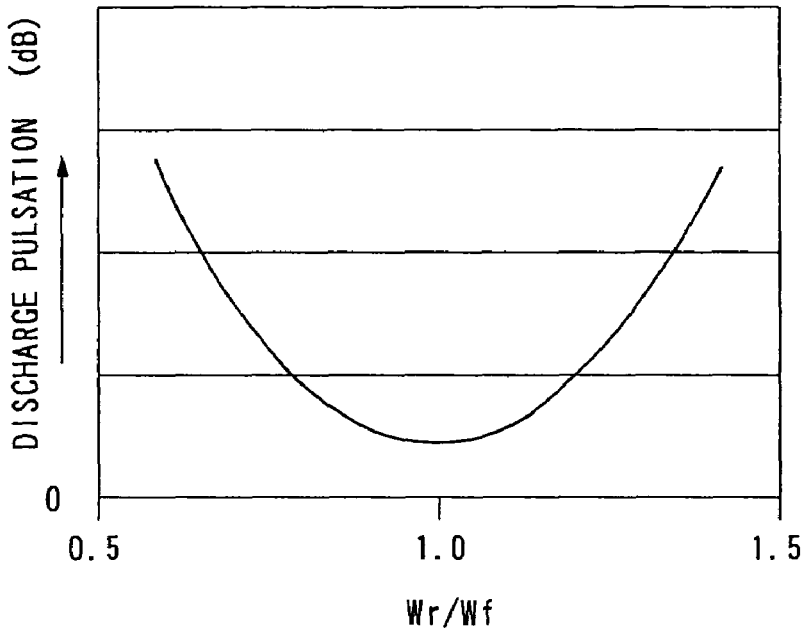
FIG. 11 is a characteristic diagram, showing the relationship between the ratio (Wr/Wf) of the width Wr of the rear-side delivery chamber 18*b* along the axial direction to the width Wf of the front-side delivery chamber 18*a* along the axial direction and the level of discharge pulsation.

In addition, with Wf representing the width of the front-side delivery chamber 18*a* along the axial direction and Wr representing the width of the rear-side delivery chamber 18*b* along the axial direction, the ratio of these widths (Wr/Wf) and the discharge pulsation achieve the relationship shown in FIG. 11. Accordingly, in order to improve the extent to which the discharge pulsation is reduced, the width Wf of the front-side delivery chamber along the axial direction and the width Wr of the rear-side delivery chamber along the axial direction may be set substantially equal to each other.

Figure 12:
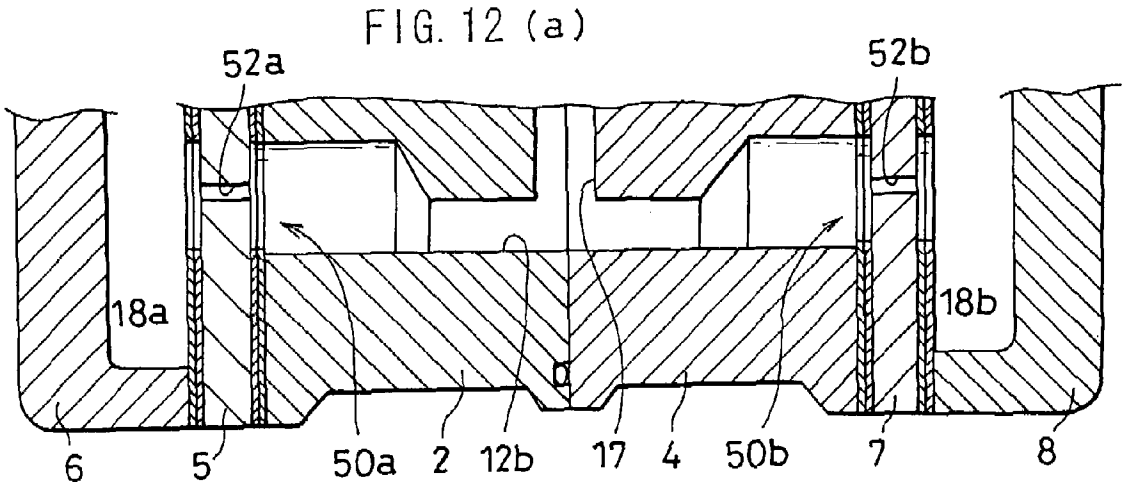
FIG. 12 presents sectional views of structural examples adopted in other reciprocating compressors according to the present invention, with FIG. 12(*a*) presenting a structural example in which the constricted portions are formed at the valve plates and FIG. 12(*b*) presenting a structural feature in which the constricted portions are each formed by a housing block and an intake valve.
Figure 12:
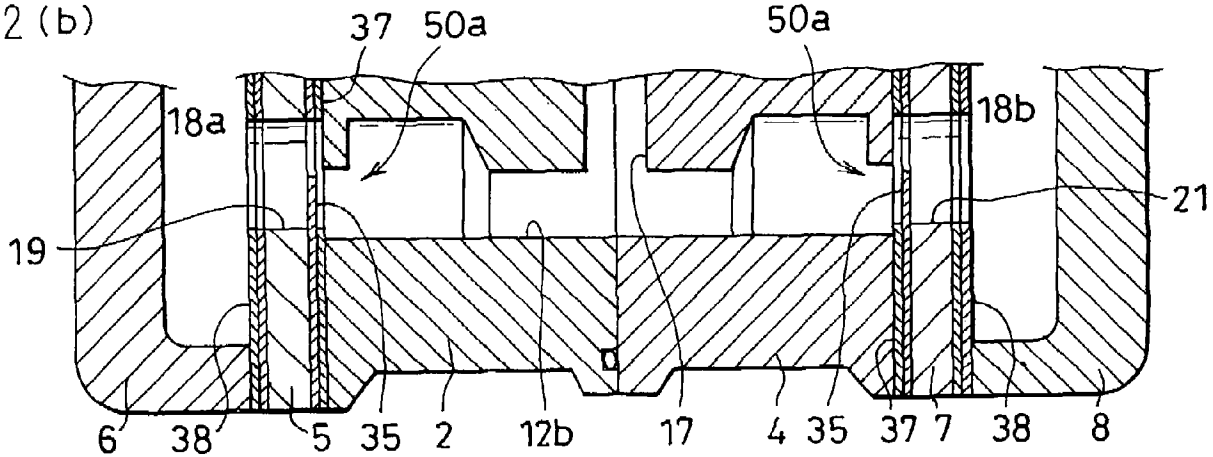
Figure 13:
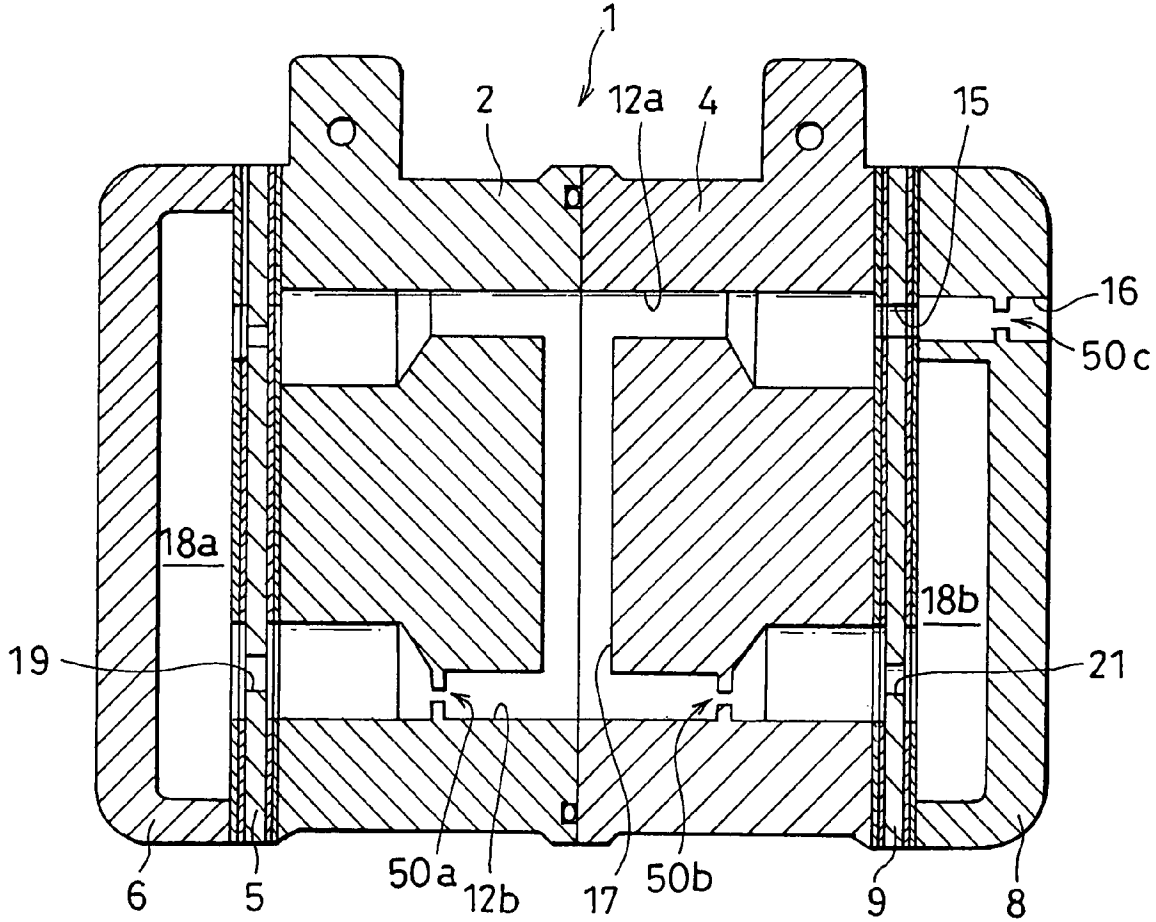
FIG. 13 is a sectional view showing a structural feature adopted in yet another reciprocating compressor according to the present invention, having constricted portions present in the delivery passage and also at the outlet port.

It is to be noted that while the constricted portions 50*a* and 50*b* disposed at positions preceding the guide passage 17 are constituted with the orifice-like passing holes 51*a* and 51*b* formed at the front-side cylinder block 2 in the structure described above, the constricted portions 50*a* and 50*b* may instead be formed as orifice-like passing holes 52*a* and 52*b* at the valve plates 5 and 7 respectively as shown in FIG. 12(*a*), or they may be formed by reducing the passage area with the cylinder blocks 2 and 4 and the intake valves 35 or the gaskets 37 (intake valves 35 are used in FIG. 12(*b*)) as shown in FIG. 12(*b*). Furthermore, in addition to any of the various structural features described above, another constricted portion 50*c* may be formed as shown in FIG. 13 by, for instance, partially reducing the passage section at the outlet port 16 or at a position immediately preceding the outlet port 16.

Figure 14:
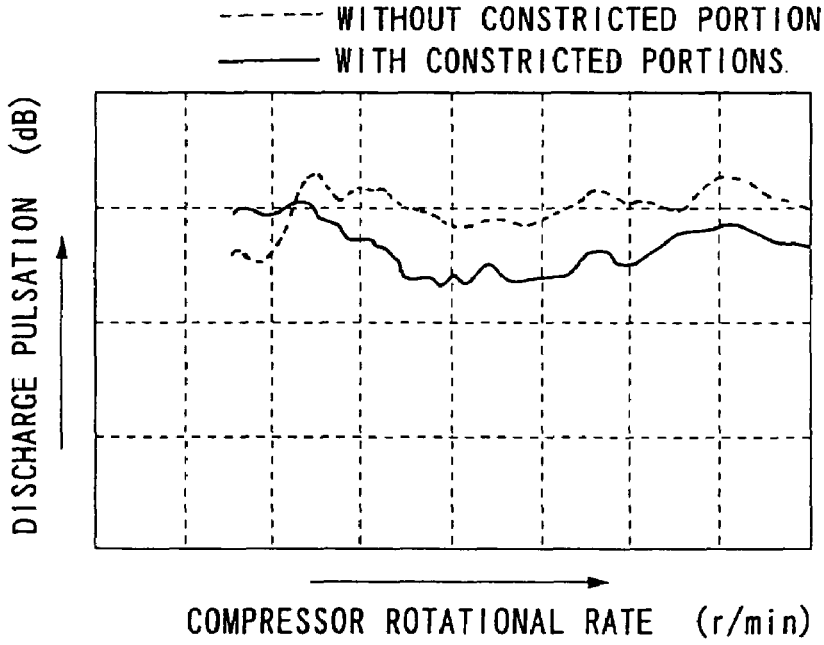
FIG. 14 is a characteristic diagram showing the relationship between the rotational rate of a compressor having constricted portions and the discharge pulsation level and the relationship between the rotational rate at a compressor that does not include a constricted portion and the discharge pulsation level.

By adopting any of these structural examples, the extent of discharge pulsation can be substantially reduced over the full range instead of only over a limited compressor rotational rate range, as shown in FIG. 14.

INDUSTRIAL APPLICABILITY

As explained above, in the reciprocating compressor according to the present invention, the delivery passage communicating with the outlet port is made to communicate with at least either the first delivery chamber or the second delivery chamber via a constricted portion having a passage section smaller than the passage section of the other delivery passage at which the other delivery passage communicates with the first and second delivery chambers. The dimensions of the constricted portion are set so that its area does not exceed the area of a passage section with a diameter of 1.5 mm. As a result, the extent of discharge pulsation occurring at the compressor can be reduced and, at the same time, the risk of the working fluid that has collected inside the compressor left in an OFF state for an extended period of time being pushed out together with the oil as the intake pressure rises to result in oil depletion inside the compressor and the compressor seizing upon startup can be eliminated.

In the reciprocating compressor, the other delivery passage may be made to communicate with the first and second delivery chambers via constricted portions formed by partially reducing the passage section. In this case, the pulsation of the working fluid guided from the first delivery chamber into the other delivery passage and the pulsation of the working fluid guided from the second delivery chamber into the other delivery passage are individually reduced at the respective constricted portions before they join each other at the guide passage. As a result, the extent of pulsation of the joined working fluid is damped and the level of discharge pulsation of the working fluid let out through the outlet port is lowered. Consequently, vibration and noise at the compressor, the piping and the like, attributable to pulsation, can be reduced.

The invention claimed is:

1. A reciprocating compressor, comprising:

a cylinder block having formed therein a plurality of cylinders;

pistons that make reciprocal movement inside said cylinders;

a first cylinder head fixed to one end of said cylinder block via a valve plate;

a second cylinder head fixed to another end of said cylinder block via a valve plate;

a first delivery chamber formed at said first cylinder head, into which a working fluid let out from a first compression space formed toward one end inside each of said cylinders is guided;

a second delivery chamber formed at said second cylinder head, into which a working fluid let out from a second compression space formed toward another end inside each of said cylinders is guided;

a plurality of delivery passages formed at said cylinder block; and a outlet port located at said cylinder block or said cylinder head, which communicates between one of said delivery passages and an external circuit, with said other delivery passage that does not communicate with said outlet port made to communicate with said first delivery chamber and said second delivery chamber and also made to communicate via a guide passage with said delivery passage in communication with said outlet port, wherein said delivery passage in communication with said outlet port is made to communicate with at least either said first delivery chamber or said second delivery chamber via a constricted portion having a smaller passage section than the passage section at areas where said other delivery passage communicates with said first delivery chamber and said second delivery chamber; and wherein the dimensions of said constricted portion are set so as to achieve an area equal to or less than the area of a circular section with a diameter of 1.5 mm, wherein said delivery passage in communication with said outlet port is formed at a position higher than said other delivery passage.

2. A reciprocating compressor, according to claim 1, wherein said constricted portion is formed at a valve plate.

3. A reciprocating compressor, comprising:

a cylinder block having formed therein a plurality of cylinders;

pistons that make reciprocal movement inside said cylinders;

a first cylinder head fixed to one end of said cylinder block via a valve plate;

a second cylinder head fixed to another end of said cylinder block via a valve plate;

a first delivery chamber formed at said first cylinder head, into which a working fluid let out from a first compression space formed toward one end inside each of said cylinders is guided;

a second delivery chamber formed at said second cylinder head, into which a working fluid let out from a second compression space formed toward another end inside each of said cylinders is guided;

a plurality of delivery passages formed at said cylinder block; and a outlet port located at said cylinder block or said cylinder head, which communicates between one of said delivery passages and an external circuit, with said other delivery passage that does not communicate with said outlet port made to communicate with said first delivery chamber and said second delivery chamber and also made to communicate via a guide passage with said delivery passage in communication with said outlet port, wherein said delivery passage in communication with said outlet port is made to communicate with at least either said first delivery chamber or said second delivery chamber via a constricted portion having a smaller passage section than the passage section at areas where said other delivery passage communicates with said first delivery chamber and said second delivery chamber; and wherein the dimensions of said constricted portion are set so as to achieve an area equal to or less than the area of a circular section with a diameter of 1.5 mm, wherein that said constricted portion is formed at said cylinder block.

4. A reciprocating compressor, comprising:

a cylinder block having formed therein a plurality of cylinders;

pistons that make reciprocal movement inside said cylinders;

a first cylinder head fixed to one end of said cylinder block via a valve plate;

a second cylinder head fixed to another end of said cylinder block via a valve plate;

a first delivery chamber formed at said first cylinder head, into which a working fluid let out from a first compression space formed toward one end inside each of said cylinders is guided;

a second delivery chamber formed at said second cylinder head, into which a working fluid let out from a second compression space formed toward another end inside each of said cylinders is guided;

a plurality of delivery passages formed at said cylinder block; and a outlet port located at said cylinder block or said cylinder head, which communicates between one of said delivery passages and an external circuit, with said other delivery passage that does not communicate with said outlet port made to communicate with said first delivery chamber and said second delivery chamber and also made to communicate via a guide passage with said delivery passage in communication with said outlet port, wherein said delivery passage in communication with said outlet port is made to communicate with at least either said first delivery chamber or said second delivery chamber via a constricted portion having a smaller passage section than the passage section at areas where said other delivery passage communicates with said first delivery chamber and said second delivery chamber; and wherein the dimensions of said constricted portion are set so as to achieve an area equal to or less than the area of a circular section with a diameter of 1.5 mm, wherein that said constricted portion is formed as a gap between said cylinder block and a valve or a gasket disposed between said cylinder block and a valve plate.

5. A reciprocating compressor, according to claim 3, wherein said constricted portion is formed at a valve plate.

6. A reciprocating compressor, according to claim 4, wherein said constricted portion is formed at a valve plate.

* * * * *